US008159206B2

(12) United States Patent
Chao et al.

(10) Patent No.: US 8,159,206 B2
(45) Date of Patent: Apr. 17, 2012

(54) VOLTAGE REFERENCE CIRCUIT BASED ON 3-TRANSISTOR BANDGAP CELL

(75) Inventors: Hio Leong Chao, Tucson, AZ (US); A. Paul Brokaw, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 653 days.

(21) Appl. No.: 12/313,834

(22) Filed: Nov. 24, 2008

(65) Prior Publication Data

US 2009/0302823 A1 Dec. 10, 2009

Related U.S. Application Data

(63) Continuation-in-part of application No. 12/157,472, filed on Jun. 10, 2008.

(51) Int. Cl.
*G05F 3/16* (2006.01)

(52) U.S. Cl. ..... 323/314; 323/313; 323/315

(58) Field of Classification Search ..... 323/312, 323/313, 314, 315, 907
See application file for complete search history.

(56) References Cited

U.S. PATENT DOCUMENTS

| | | | | |
|---|---|---|---|---|
| 3,617,859 | A | 11/1971 | Dobkin et al. | 323/4 |
| 6,172,555 | B1 | 1/2001 | Gusinov | 327/539 |
| 6,300,752 | B1 * | 10/2001 | Mack | 323/313 |
| 6,528,979 | B2 * | 3/2003 | Kimura | 323/313 |
| 7,208,930 | B1 * | 4/2007 | Tran et al. | 323/314 |
| 7,253,597 | B2 * | 8/2007 | Brokaw | 323/314 |
| 7,372,242 | B2 * | 5/2008 | Xi | 323/313 |
| 2006/0139022 | A1 * | 6/2006 | Xi | 323/313 |

OTHER PUBLICATIONS

PCT Notification of the International Search Report and the Written Opinion of the International Searching Authority; Dated Mar. 5, 2010; For International Application No. PCT/US2009/006193.
Malcovati. Piero et al.; Curvature-Compensated BiCMOS Bandgap With 1-V Supply Voltage; IEEE Journal of Solid-State Circuits; vol. 36; No. 7; Jul. 1, 2001: pp. 1076-1081.
U.S. Patent Application Publication No. US 2005/0151528 A1; Marinca; Jul. 14, 2005.
U.S. Patent Application Publication No. US 2008/0088361 A1; Kimura; Apr. 17, 2008.
Camenzind, Hans; "Designing Analog Chips"; Chapter 7: Bandgap References; Feb. 2005; pp. 7-1 through 7-14.
Widler, R.J., "New Developments in IC Voltage Regulators", IEEE International Solid-State Circuits Conference (1970), p. 158.
Analog Devices, Dacport Low Cost, Complete μP-Compatible 8-Bit DAC, AD558, pp. 1-8.

* cited by examiner

*Primary Examiner* — Matthew Nguyen
*Assistant Examiner* — Lakaisha Jackson
(74) *Attorney, Agent, or Firm* — Koppel, Patrick, Heybl & Philpott

(57) ABSTRACT

A voltage regulator comprises first and second bipolar transistors operating at different current densities; a resistance is connected between their bases across which $\Delta V_{BE}$ appears. A third bipolar transistor is connected such that its base voltage is equal to that of the first transistor or differs by a PTAT amount. A current mirror balances the collector current of one of the second and third transistors with an image of the collector current of the first transistor when an output node is at a unique operating point. The operating point includes both PTAT and CTAT components, the ratio of which can be established to provide a desired temperature characteristic. A feedback transistor provides current to the bases of the bipolar transistors and to the output node and is driven by the current mirror output to regulate the voltage at the output node by negative feedback.

37 Claims, 9 Drawing Sheets

VOLTAGE REFERENCE CIRCUIT BASED ON 3-TRANSISTOR BANDGAP CELL

RELATED APPLICATIONS

This application is a continuation-in-part of application Ser. No. 12/157,472 filed Jun. 10, 2008, incorporated herein by reference in its entirety.

BACKGROUND OF THE INVENTION

1. Field of the Invention

This invention relates generally to voltage regulators.

2. Description of the Related Art

A regulated voltage is often required in an integrated circuit (IC). In some instances, a variable current is provided to a voltage regulator circuit within the IC, which must be designed to absorb variations in the current while providing a regulated voltage that does not vary as a function of current or, ideally, temperature.

One such regulator is shown in FIG. 1, which was described in R. J. Widlar, "New Developments in IC Voltage Regulators", IEEE International Solid-State Circuits Conference (1970), p. 158. The regulator is driven with a supply current I. Transistor Qa is operated at a higher current density than transistor Qb, with the differential between the base-emitter voltages of Qa and Qb ($\Delta V_{BE}$) appearing across resistor Rc; $\Delta V_{BE}$ will increase with increasing temperature, therefore making it proportional-to-absolute-temperature (PTAT). If Qa and Qb have high current gains, the voltage across Rb will be proportional to $\Delta V_{BE}$, and thus also PTAT. Qc serves as a gain stage that regulates the output voltage $V_{ref}$ at a voltage equal to the drop across Rb, plus the emitter-base voltage of Qc, which is complementary-to-absolute-temperature (CTAT). That is:

$$V_{ref} = \frac{Rb}{Rc}\Delta V_{BE} + V_{BE,Qc}$$

This equation can be shown to imply that $V_{ref}$ will be temperature compensated when it is equal to the bandgap voltage of silicon extrapolated to 0° K. For the circuit shown in FIG. 1, $V_{ref}$ is equal to the bandgap voltage when Qa and Qb operate at a 10:1 current ratio.

This circuit does have some shortcomings, however. As shown, $V_{ref}$ is limited to a value no greater than the bandgap voltage. In addition, changes in I will change the current in Qc, as well as the currents in Qa and Qb, causing a small departure from the nominal $V_{ref}$ value.

SUMMARY OF THE INVENTION

A voltage regulator circuit is presented which overcomes the problems noted above, providing a tightly regulated output voltage which can be greater than the bandgap voltage, while requiring a relatively small number of components.

The present voltage regulator circuit comprises first and second bipolar transistors arranged to operate at different current densities. A first resistance is connected between the transistors such that the difference between their base-emitter voltages ($\Delta V_{BE}$) appears across it. A third bipolar transistor is connected to conduct a current which varies with the voltage at the base of the first transistor, and the circuit is arranged such that the voltages at the bases of the first and third bipolar transistors are equal or differ by a voltage which is PTAT. A current mirror is arranged to balance the collector current of one of the second and third transistors with an image of the collector current of the first transistor when the output node is at a unique operating point. A feedback transistor provides current to the bases of the bipolar transistors and to the output node and is driven by the current mirror output to regulate the voltage at the output node by negative feedback.

When so arranged, the operating point includes both PTAT and CTAT components, the ratio of which can be established to provide a desired temperature characteristic. For example, the ratio of the CTAT and PTAT components can be set such that the operating point is temperature invariant to a first order, at a voltage which is approximately equal to the bandgap voltage of silicon at 0° K or a multiple thereof.

Various possible circuit embodiments are described. In one embodiment, a correction current is generated which substantially reduces the magnitude of the (kT/q)ln(To/T) curvature component in the CTAT component of the current conducted by the feedback transistor that would otherwise be present. Another embodiment serves as a PTAT voltage generator, in that it provides a PTAT voltage at the output node. A means of reducing the dependence of the output voltage on the beta values of the bipolar transistors is also described.

These and other features, aspects, and advantages of the present invention will become better understood with reference to the following drawings, description, and claims.

DETAILED DESCRIPTION OF THE INVENTION

Figure 1:
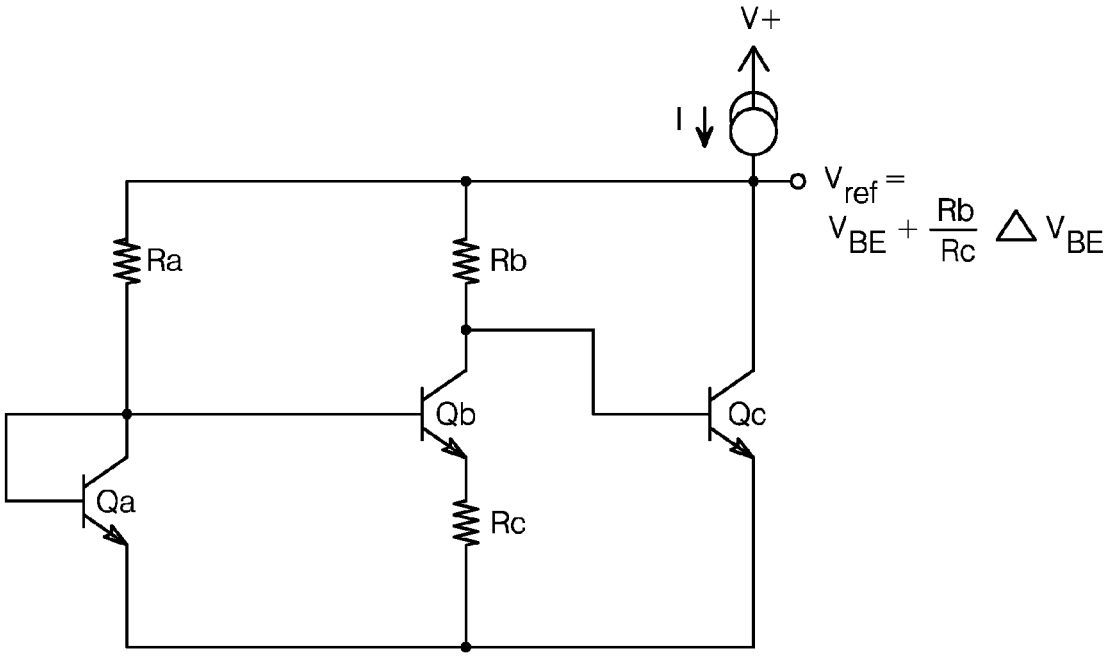
FIG.1 (Prior Art)
FIG. 1 is a schematic diagram of a known voltage regulator.
Figure 2A:
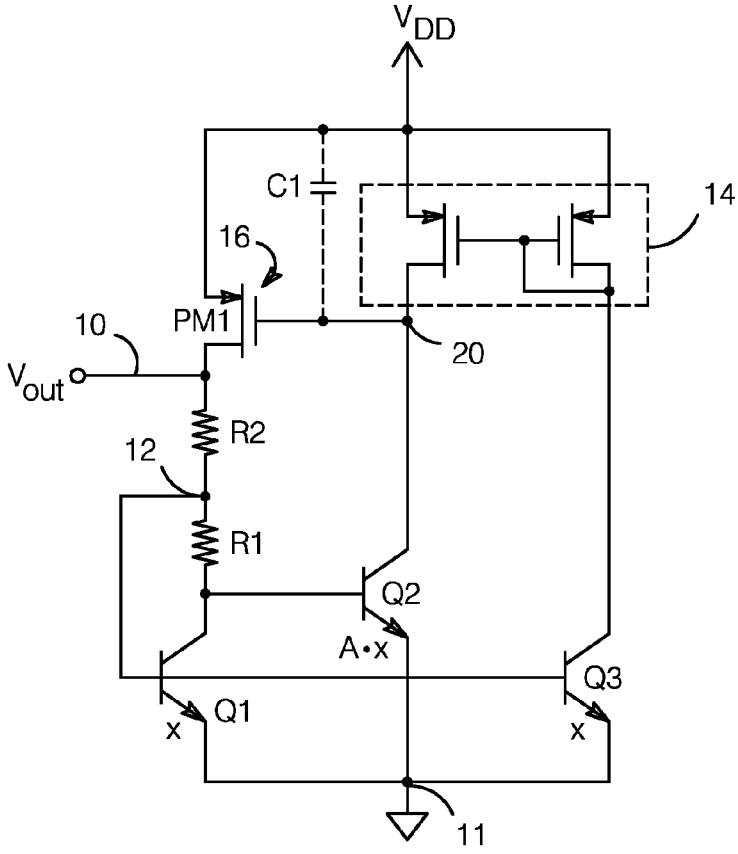
FIG. 2*a* is a schematic diagram of illustrating one possible embodiment of a voltage regulator circuit per the present invention.

The principles of a voltage regulator circuit in accordance with the present invention are illustrated in FIG. 2*a*. The circuit is configured as a 3-terminal regulator, though other regulator configurations employing the same principles are possible. The regulator circuit comprises a node 10 at which the regulator's output voltage $V_{out}$ is provided; the regulator is powered by a supply voltage $V_{DD}$ and a circuit common point 11 which can include ground. Bipolar transistors Q1 and Q2 and a resistance R1 are connected such that the difference between the base-emitter voltages of Q1 and Q2 ($\Delta V_{BE}$) appears across R1. In this exemplary embodiment, a resistance R2 is connected between output node 10 and a node 12 at the junction of R1 and the base of Q1, such that R2 conducts the current in R1 and Q1. R1 and R2 form a voltage divider, with the voltage across R2 equal to R2/R1 times the voltage across R1. The regulator circuit is arranged such that Q1 and Q2 operate at different current densities.

A third bipolar transistor Q3 is connected such that the voltages at the bases of Q1 and Q3 are equal (as shown in FIG. 2*a*) or differ by a voltage which is PTAT, such that Q3 conducts a current which varies with the voltage at the base of Q1. A current mirror 14 is arranged to balance the collector current of Q2 or Q3 with an image of the collector current of Q1 when output node 10 is at a unique operating point.

Figure 2B:
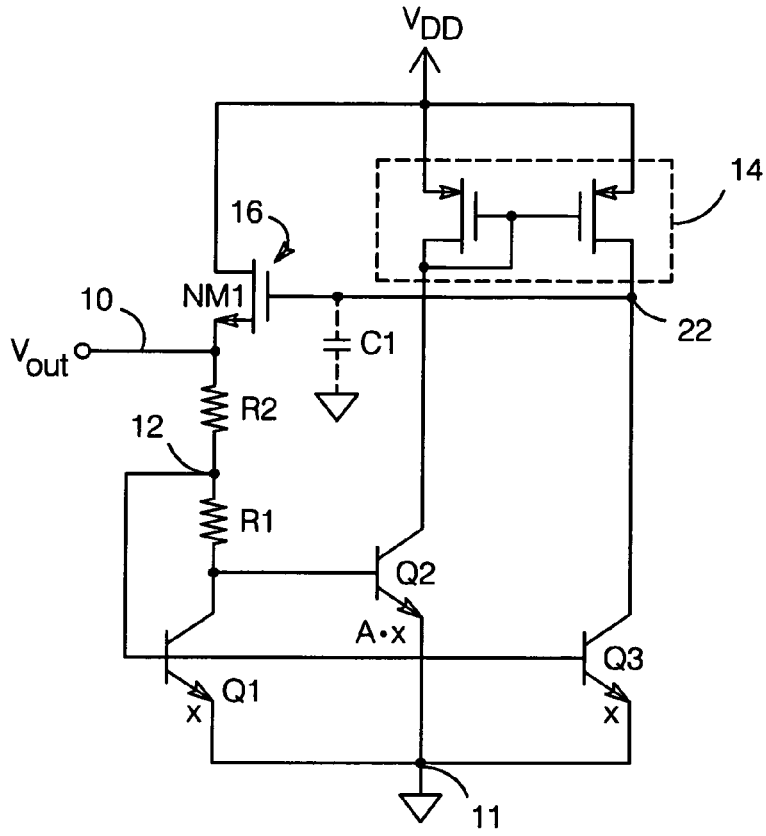
FIG. 2*b* is a schematic diagram of another possible embodiment of a voltage regulator circuit per the present invention.

The regulator circuit includes a feedback transistor 16, shown here as a PMOS FET PM1, which is connected to output node 10 and provides current to the output node and to the bases of each of Q1-Q3; transistor 16 is driven by the output of current mirror 14 such that it acts to regulate $V_{out}$ by negative feedback. A p-type or n-type transistor can be used as needed to provide the negative feedback required to stabilize $V_{out}$. Transistor 16 can be a FET (as shown), or a bipolar transistor. For this and all other embodiments described herein, the negative feedback loop can be frequency compensated with a capacitance C1 connected between the output of current mirror 14 and the supply voltage (as shown in FIG. 2*a*) or circuit common (as shown in FIG. 2*b*); connecting C1 to circuit common provides better power supply rejection.

The emitter area of transistor Q2 is preferably larger than that of transistor Q1, so that $\Delta V_{BE}$ is across R1 when Q2 and Q3 operate at equal currents. When so arranged, $\Delta V_{BE}$ is a PTAT voltage given by:

$\Delta V_{BE}=\ln(A)*(kT/q)$, where A is the ratio between the emitter area of Q2 with respect to that of Q3, k is Boltzmann's constant, T is the temperature in degrees Kelvin, and q is the magnitude of electronic charge. Since approximately the same current flows in R2 as R1, the voltage across R2 will be a PTAT image of $\Delta V_{BE}$.

The mirror can be arranged as shown in FIG. 2*a*, such that Q3's current drives mirror 14 and Q2 sinks the mirror output; for this case, feedback transistor 16 must be p-type. Alternatively, as shown in FIG. 2*b*, Q2's current drives mirror 14 and Q3 sinks the mirror output; for this arrangement, feedback transistor 16 must be n-type, such as the NMOS FET NM1 shown. The point where these currents meet (node 20 in FIG. 2*a*, node 22 in FIG. 2*b*) is very sensitive to the balance between them, and rises or falls to cause feedback transistor 16 to conduct as needed to maintain the balance and thereby regulate $V_{out}$. For either embodiment, output voltage $V_{out}$ is approximately given by:

$$V_{out}\approx V_{BE}+\Delta V_{BE}(R2/R1).$$

Figure 2C:
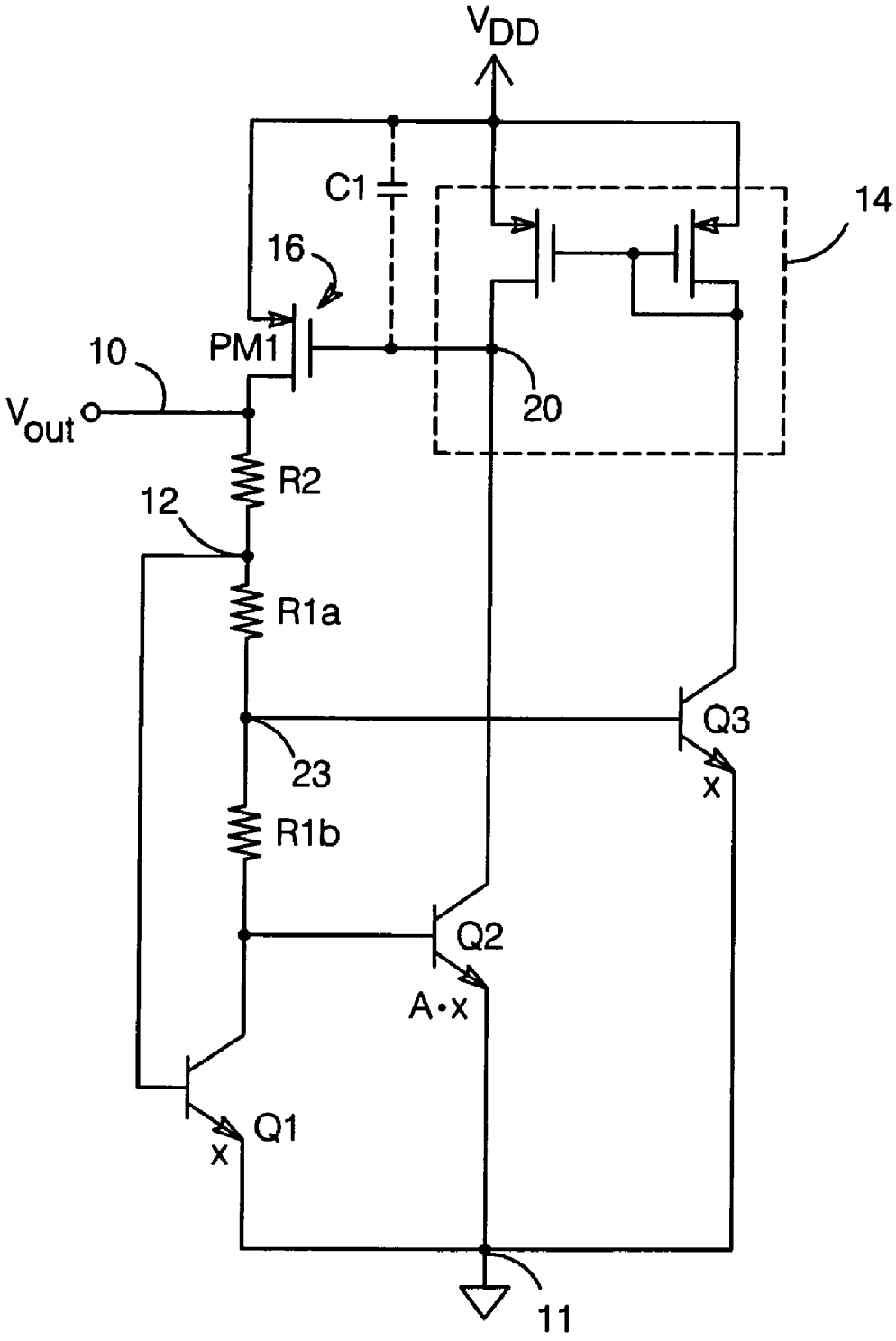
FIG. 2*c* is a schematic diagram of another possible embodiment of a voltage regulator circuit per the present invention.

As noted above, third bipolar transistor Q3 is connected such that the voltages at the bases of Q1 and Q3 are equal (as shown in FIGS. 2*a* and 2*b*) or differ by a voltage which is PTAT, such that Q3 conducts a current which varies with the voltage at the base of Q1. An example of the latter case is shown in FIG. 2*c*. Here, resistance R1 is split between resistances R1*a* and R1*b* such that the sum of the resistances R1*a*+R1*b*=R1. When the current in mirror 14 is balanced, the voltage across resistance R1*b* is the $\Delta V_{BE}$ voltage. Neglecting base currents, the current in resistance R1*b* is the same as the current in R1*a*, and so the voltage across resistance R1*a* is a copy of the $\Delta V_{BE}$ voltage across R1*b*, assuming R1*a* and R1*b* are equal. For this embodiment, the output voltage $V_{out}$ is given by: $V_{out}\approx V_{BE}+2*\Delta V_{BE}*[R2/(R1a+R1b)]$. Having a larger $\Delta V_{BE}$ voltage helps to reduce the gain error introduced by the resistor ratio R2/R1. Note that in this arrangement, the collector currents of transistor Q1 and Q3 are different because of the difference in their base voltages.

Figure 3:
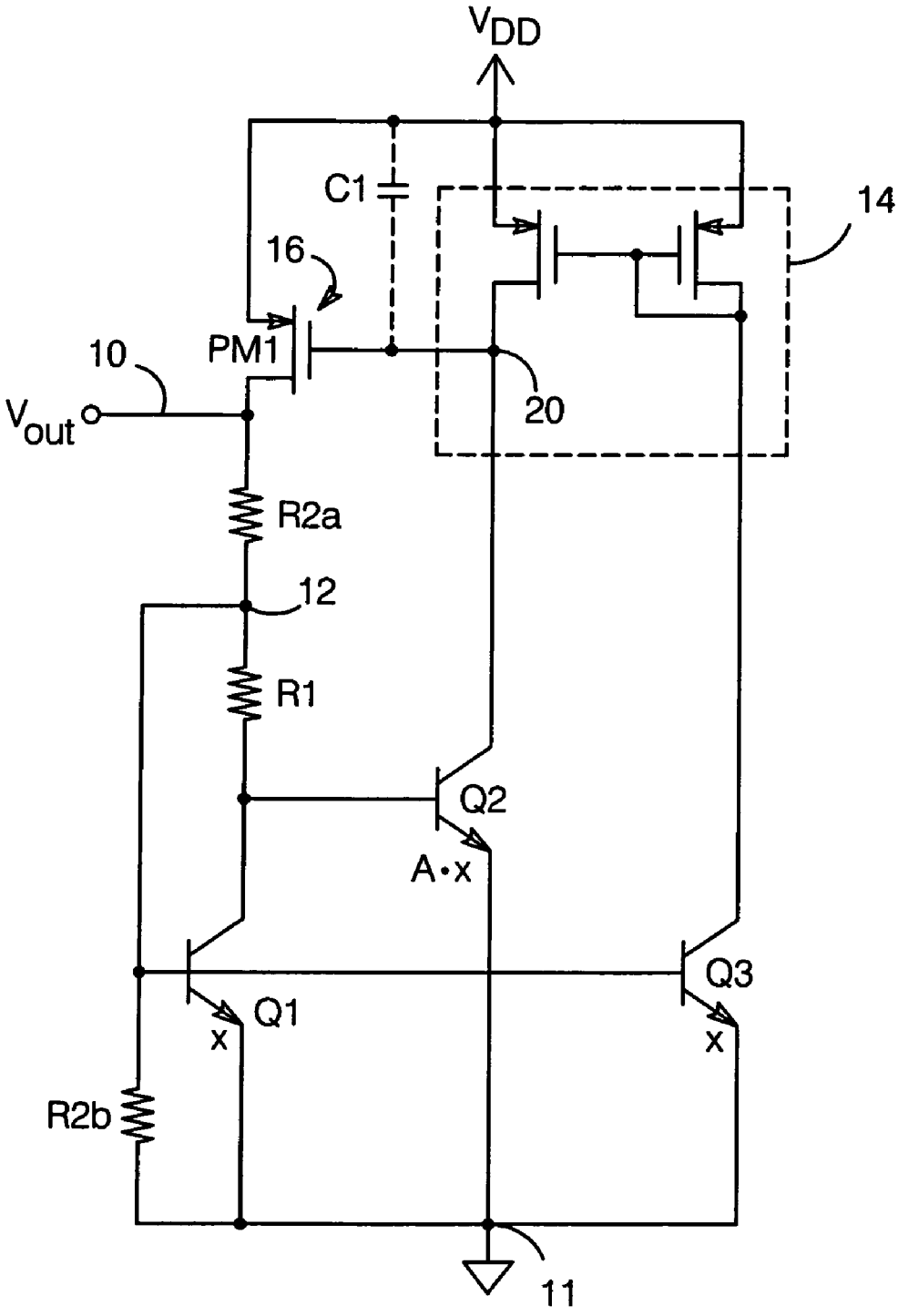
FIG. 3 is a schematic diagram of another possible embodiment of a voltage regulator circuit per the present invention.

FIGS. 2*a*, 2*b* and 2*c* are exemplary embodiments of regulator circuits that provide an output voltage equal to the bandgap voltage of silicon at 0° K. An embodiment capable of providing an output voltage equal to a multiple of the bandgap voltage is shown in FIG. 3. Here, resistance R2 is relabeled as R2*a*, and a new resistance R2*b* is connected between the base and emitter of Q1. When base currents are neglected, the output voltage is given by: $V_{out}=V_{BE}*[1+(R2a/R2b)]+\Delta V_{BE}*(R2a/R1)$. When so arranged, the output voltage is temperature invariant to a first order when the output is set equal to 1+(R2*a*/R2*b*) times the bandgap voltage. This technique can also be employed to the other regulator circuit embodiments, such as the one shown in FIG. 4.

Referring back to FIG. 2*a*, each of Q1, Q2 and Q3 has an approximately equal base current $i_b$, each of which flows through resistance R2. The base currents split at node 12, with $2*i_b$ flowing to Q1 and Q3, and $1*i_b$ flowing through resistance R1 to Q2. With these base currents present, the voltage drop across R2 will depend on $\Delta V_{BE}$, the resistance ratio R2/R1, and the base currents through the resistances. Thus, the base currents modify the voltage drop across R2, and thereby affect the value of $V_{out}$ and the temperature compensation.

One way in which the effect of base current on $V_{out}$ may be reduced is now described. When base current is neglected, the voltage across R2 is given by $$V_{R2}=\frac{R2}{R1}\Delta V_{BE}.$$

Rearranging this equation:

$$\frac{V_{R2}}{\Delta V_{BE}}=\frac{R2}{R1},$$

which implies that the voltage drop across R2 is independent of base current when the voltage ratio $$\frac{V_{R2}}{\Delta V_{BE}}$$

equals the resistance ratio R2/R1. By inspection, the voltage ratio $$\frac{V_{R2}}{\Delta V_{BE}}$$

is given by:

$$\frac{V_{R2}}{\Delta V_{BE}} = \frac{R2(i_c + 3i_b)}{R1(i_c + i_b)}$$

Because there is more base current through R2 than through R1, the voltage across R2 becomes dependent on the base current.

Figure 4:
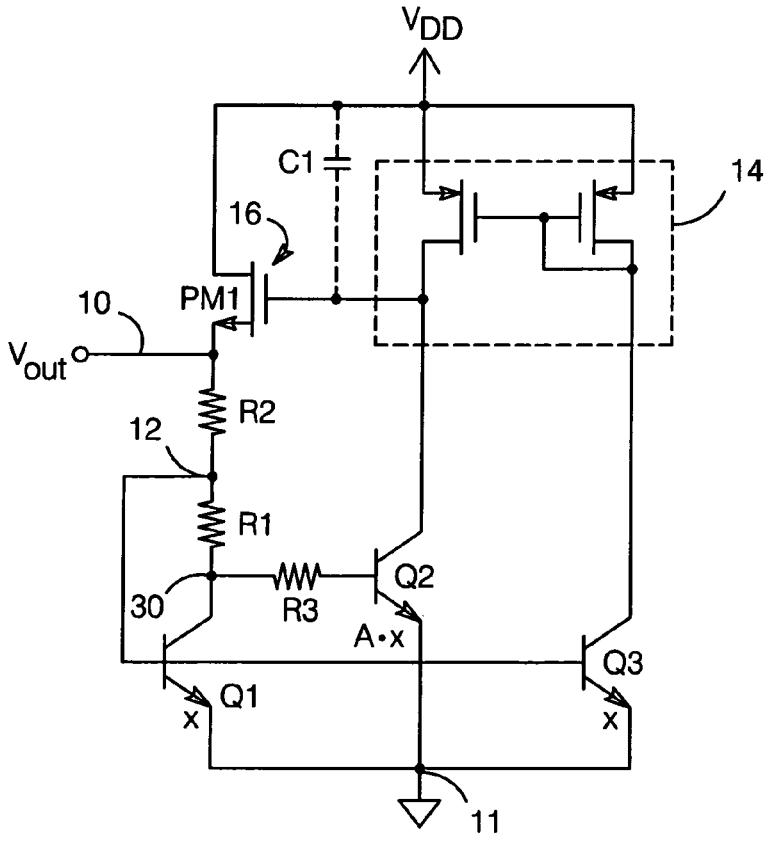
FIG. 4 is a schematic diagram of an embodiment of a voltage regulator circuit per the present invention which includes a means of reducing the dependence of the output voltage on the beta values of the bipolar transistors

FIG. 4 shows a modification of the FIG. 2*a* circuit which includes an added resistance R3, connected between a node 30 at the junction of the Q1 collector and R1, and the base of Q2. Since the current through R3 is the base current of Q2, the voltage developed across the resistance is R3*$i_b$ volts. With added resistance R3, the voltage ratio $$\frac{V_{R2}}{\Delta V_{BE}}$$

becomes:

$$\frac{V_{R2}}{\Delta V_{BE}} = \frac{R2(i_c + 3i_b)}{R1(i_c + i_b) + R3(i_b)}$$

Setting this equation equal to R2/R1 and solving for R3 gives: R3=2*R1. Thus, when R3=2*R1, the voltage across R2 is independent of the base current. Therefore, adding resistance R3 and setting it equal to 2*R1 compensates for the effect of base currents, making $V_{out}$ less dependent upon beta. This technique may also be employed to the other regulator circuit embodiments described herein.

Figure 5:
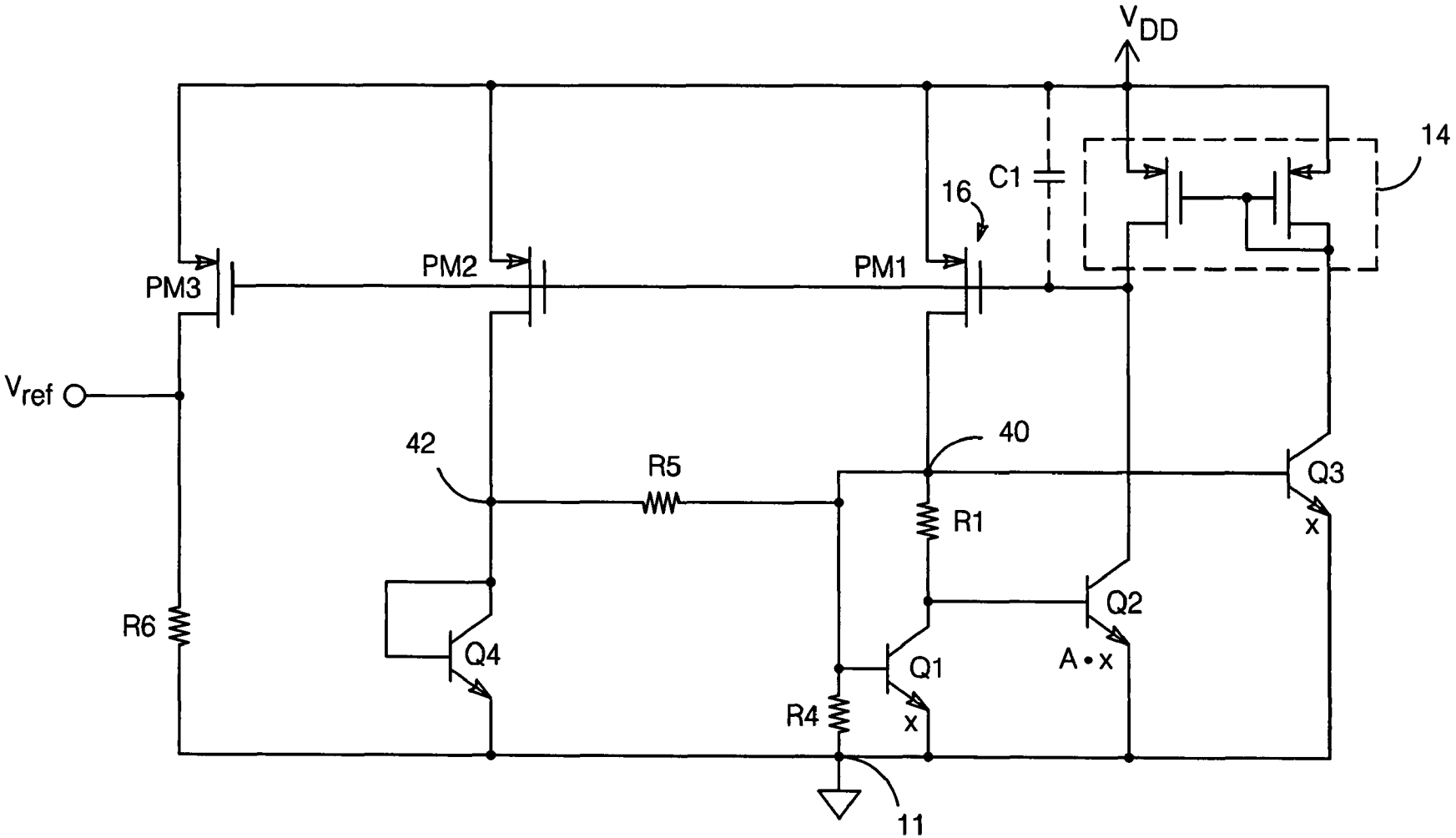
FIG. 5 is a schematic diagram of an embodiment of a voltage regulator circuit per the present invention which generates a correction current that substantially reduces the magnitude of the (kT/q)ln(To/T) curvature component in the CTAT component of the current conducted by the feedback transistor that would otherwise be present.

In FIGS. 2*a*, 2*b*, 3 and 4, the base-emitter voltage of a bipolar transistor (specifically, the $V_{BE}$ of Q1) provides the CTAT component of the voltage at node 10. However, as is well-known, there is a residual curvature component in the $V_{BE}$ vs. temperature characteristic. FIG. 5 is a schematic diagram of an embodiment of the present regulator circuit which adds curvature correction to the output voltage. Only 2 resistances and 2 transistors are added: a resistance R4 is connected between the base and emitter of Q1, a resistance R5 is connected between node 40 and a node 42, a transistor PM2 is connected to mirror the current in PM1 to node 42, and a diode-connected bipolar transistor Q4 is connected between node 42 and circuit common. Here, feedback transistor 16 is connected directly to R1 at a node 40; resistance R2 is not needed. With these additional components in place, the curvature term can be extracted in the form of a current, which is then deliberately scaled and injected back to the regulator circuit to cancel the $V_{BE}$ curvature and thereby increase the stability of the current in PM1 over temperature. A reference voltage $V_{ref}$ can then be provided by, for example, adding a transistor PM3 connected to mirror the PM1 current into a resistance R6, with $V_{ref}$ taken at the junction of PM3 and R6.

The analysis of the FIG. 5 circuit configuration which follows assumes that all resistances are ideal and the base currents are negligible. Assume initially that resistance R5 is large, such that transistors PM2 and Q4 have a negligible effect on circuit operation. A CTAT current is generated by the resistance R4 connected across the base-emitter of Q1, and a PTAT current is generated by R1, due to the $\Delta V_{BE}$ voltage across it. PM1 provides all the current for R1 and R4, and thus contains the sum of the PTAT and CTAT currents. By establishing the proper ratio between the PTAT and CTAT currents, the temperature coefficient of the PTAT current can be canceled by the CTAT current. When this condition occurs, the current in PM1 is substantially "ZTAT"—i.e., invariant with respect to absolute temperature. PM3 mirrors the ZTAT current from PM1 to resistance R6 to generate $V_{ref}$.

Unfortunately, the current in PM1 is not perfectly ZTAT, but rather has a curvature component as a consequence of using the base-emitter voltage of Q1 to generate the CTAT current. It will be demonstrated that, when arranged as shown in FIG. 5, resistance R5 provides a correction current to compensate for this curvature component.

A bipolar transistor's $V_{BE}$ voltage can be expressed as a function of temperature and current using the value VBE0—defined as the value of $V_{BE}$ measured at a reference temperature To while conducting a reference current Io—as follows:

$$V_{BE}=VG0+T(VBEO-VG0)/To+(kT/q)\ln(ic/Io)+(mkT/q)\ln(To/T),$$

where VG0 is the bandgap voltage of silicon extrapolated to 0° K, m is a fabrication process-specific constant, and ic is the transistor's collector current. Assume that collector current ic is ZTAT such that ic=Io for all temperatures. This makes the ln(ic/Io) term from the $V_{BE}$ equation zero, such that the equation can be rewritten as:

$$V_{BE,ZTAT}=VG0+T(VBEO-VG0)/To+m(kT/q)\ln(To/T),$$

in which the first and second terms correspond to the first order temperature coefficient of $V_{BE}$ and the last term is the curvature component of $V_{BE}$.

Assume now that collector current ic is PTAT. This PTAT collector current can be expressed as ic=Io(T/To). Substituting this ic relationship into the $V_{BE}$ equation gives:

$$V_{BE,PTAT}=VG0+T(VBEO-VG0)/To+(m-1)(kT/q)\ln(To/T).$$

The first and second terms of this equation are the same as those in the $V_{BE,ZTAT}$ expression, but the last term is one (kT/q)ln(To/T) less. Thus, the curvature component of $V_{BE}$ can be extracted by taking the difference of $V_{BE,PTAT}$ and $V_{BE,ZTAT}$:

$$V_{BE,ZTAT}-V_{BE,PTAT}=(kT/q)\ln(To/T).$$

Referring back to FIG. 5, $V_{BE,PTAT}$ is the $V_{BE}$ of Q1, because its collector current is the PTAT current in R1. $V_{BE,ZTAT}$ is the $V_{BE}$ of Q4, as its collector current is a scaled version of the PM1 current which is approximately ZTAT. Ideally, Q4's collector current would be exactly ZTAT, but the correction current in R5 introduces an error that complicates this. One way of reducing this error is by making Q4's collector current large relative to the correction current in R5, by making PM2 large. The emitter area of Q4 is properly sized to match the current density of Q1 at a reference temperature. Then, with $V_{BE,PTAT}$ and $V_{BE,ZTAT}$ across R5, the current in R5 has the same form as the $V_{BE}$ curvature: (1/R5) (kT/q)ln(To/T). R5 converts the curvature component into current and injects it back to the base of Q1. R5 is sized to provide the amount of curvature current that is needed to compensate the curvature of the CTAT current in R5. When so arranged, voltage $V_{ref}$ is given by:

$$Vref = R6 \cdot \left[ \frac{VG0}{R4} + \frac{VBEO - VG0}{R4} \frac{T}{To} + \frac{(m-1)}{R4}\left(\frac{kT}{q}\right)\ln\left(\frac{To}{T}\right) - \frac{1}{R5}\left(\frac{kT}{q}\right)\ln\left(\frac{To}{T}\right) + \frac{\Delta VBE}{R1} \right].$$

The curvature term (kT/q)ln(To/T) can be cancelled by setting R5=R4/(m−1). After cancelling the curvature term, the remaining terms have only a first order effect which can be cancelled by choosing the right amount of PTAT current with resistance R1. When so arranged, $V_{ref}$ is simply VG0 times the resistance ratio R6/R4.

The curvature correction scheme described above works well as long as the error introduced to the collector current of Q4 by the correction current of R5 is small. As noted above, a simple way to reduce this error is to make the collector current of Q4 large with respect to R5's correction current while maintaining the same emitter current density. However, this approach increases the overall power consumption of the circuit and requires larger devices.

Figure 6:
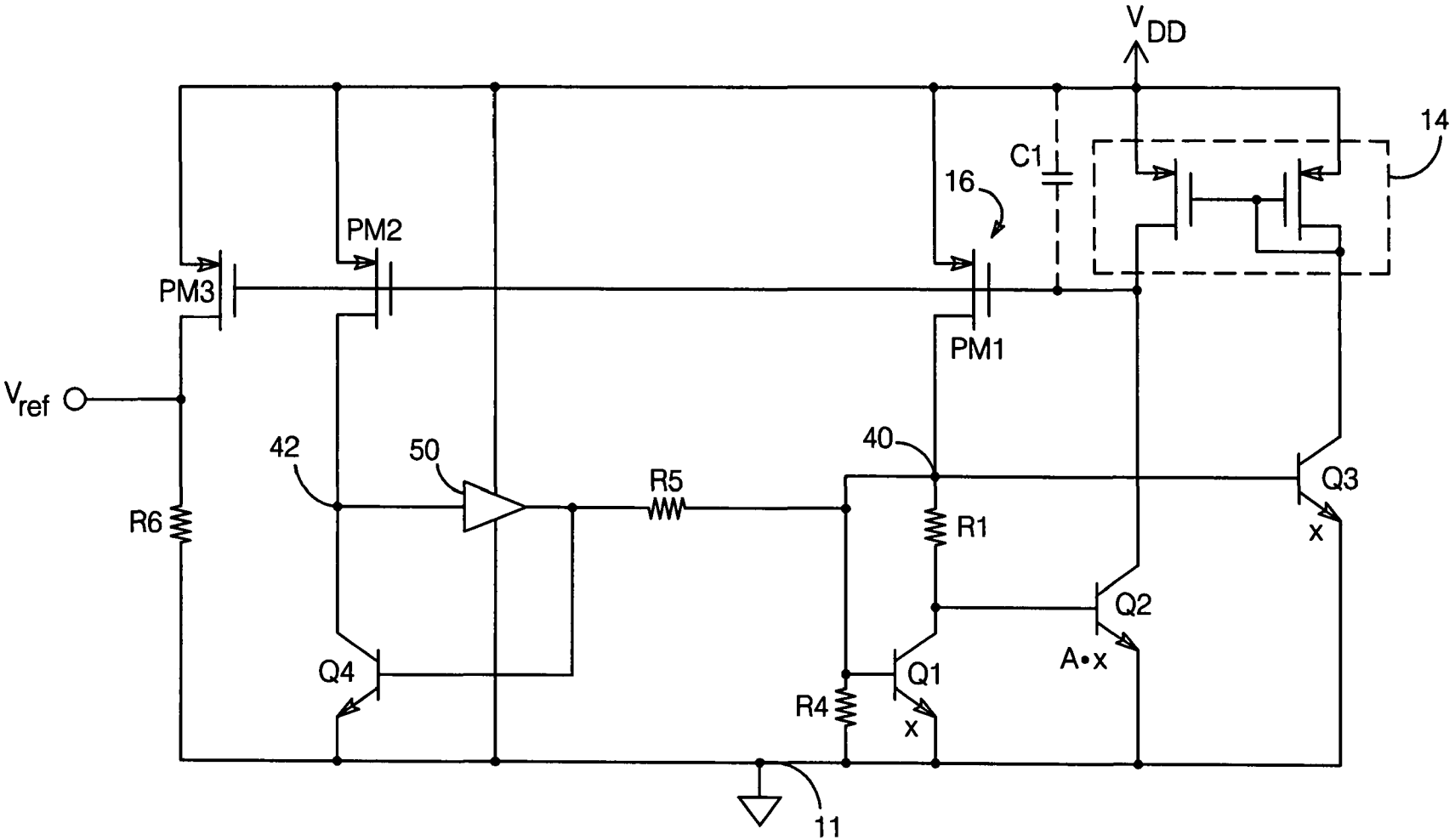
FIG. 6 is a block/schematic diagram of another possible embodiment of a voltage regulator circuit per the present invention which generates a correction current that substantially reduces the magnitude of the (kT/q)ln(To/T) curvature component present in the CTAT component of the current conducted by the feedback transistor.

An alternative way to reduce the error introduced by the correction current of R5 is to buffer the $V_{BE}$ voltage of Q4, such that the buffer provides the curvature correction current needed by R5 without disturbing the ZTAT current provided to Q4 by PM2. An embodiment illustrating this possibility is shown in FIG. 6. Here, a buffer amplifier 50 has its input connected to the collector of Q4 and its output drives the base of Q4 and resistance R5.

In operation, buffer 50 sources or sinks current depending on the operating temperature with respect to reference temperature To, since the direction of the current in R5 is determined by the voltage across it, given by: $V_{BE,ZTAT}-V_{BE,PTAT}=$ (kT/q)ln(To/T). When the circuit operates at the reference temperature, the base voltages of Q1 and Q4 are equal and so no current flows in R5. When the circuit operates at a temperature below the reference temperature, the base voltage of Q4 is slightly higher than that of Q1, and so the R5 current is sourced by the buffer; when the circuit operates at a temperature above the reference point, the buffer sinks the current in R5.

The buffer configuration employs negative feedback to stabilize the input and output voltage. The feedback loop consists of the buffer itself and bipolar transistor Q4. If there is an increase in the voltage at the buffer's input, its output will increase and pull up the base of Q4. This causes Q4 to turn on more, which in turn pulls down the buffer's input.

Figure 7:
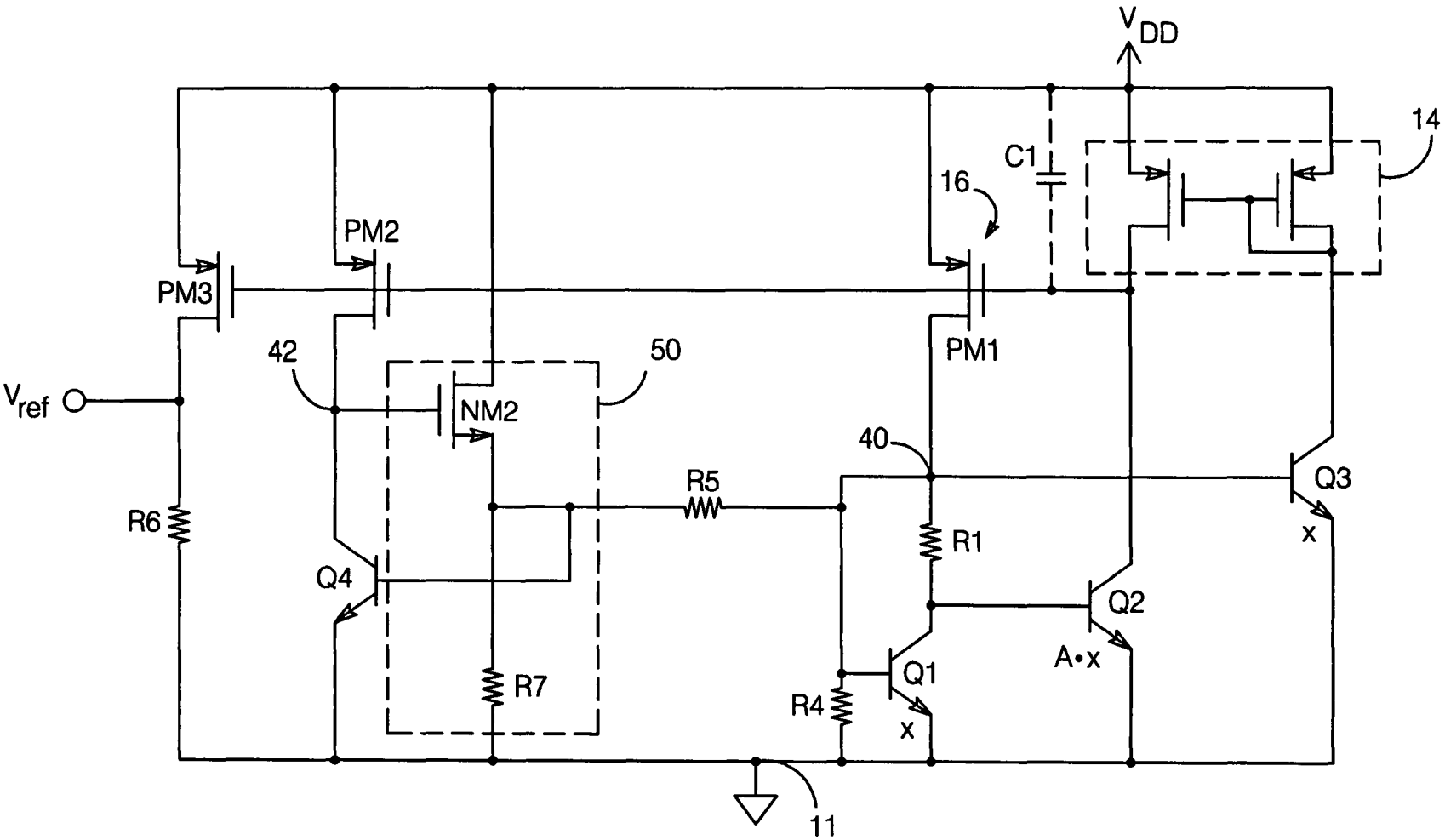
FIG. 7 is a schematic diagram which includes one possible implementation of a buffer amplifier as might be used in the voltage regulator circuit of FIG. 6.

One possible implementation for buffer amplifier 50 is shown in FIG. 7. The gate and source of an NMOS transistor NM2 are connected to the collector and base of Q4, respectively, and a resistance R7 is connected between the source of NM2 and circuit common. NM2 acts as a source follower and provides the current required to drive R5, R7 and the base of Q4. Resistance R7 provides the buffer's current sink capability.

It should be noted that if the reference temperature is set above the maximum specified operating temperature, then the correction current in R5 will only be sourced by the buffer. In this case, the buffer will only have to source current to R5 throughout the entire operating temperature range, and thus under these conditions, resistance R7 may be omitted.

It should be noted that buffer amplifier 50 could be implemented in many different ways. For example, resistance R7 could be replaced with a current source and the buffer would still work in the same way.

Figure 8:
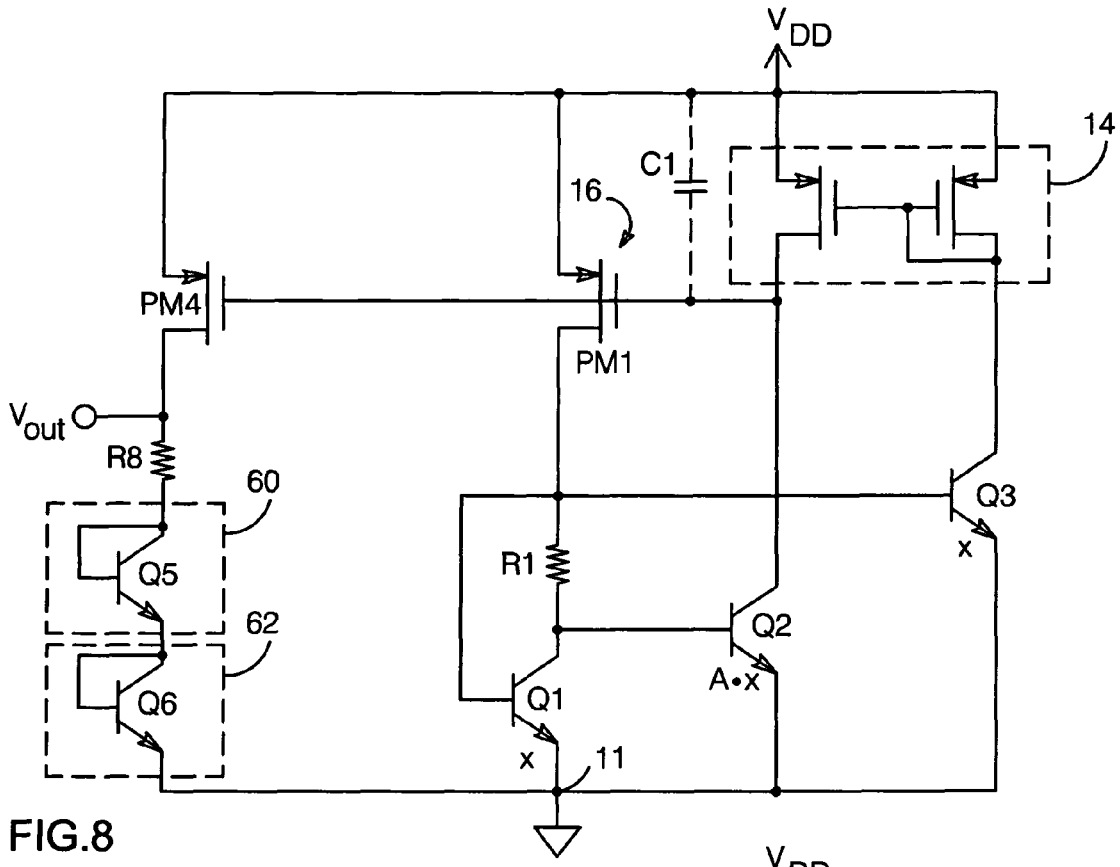
FIG. 8 is a schematic diagram of an embodiment of a voltage regulator circuit per the present invention which enables the output voltage to be approximately equal to the bandgap voltage of silicon at 0° K or a multiple thereof.

The present regulator circuit can be arranged to produce an output voltage equal to the bandgap voltage of silicon at 0° K or a multiple thereof. FIG. 8 shows a possible implementation which generates an output voltage equal to twice the bandgap voltage. Resistance R1, Q1-Q3, current mirror 14 and feedback transistor 16 are arranged such that the current in PM1 is PTAT at equilibrium. A transistor PM4 mirrors the PTAT current from PM1 into a resistance R8, thereby generating a PTAT voltage across R8. Two p-n junction devices 60, 62—here, diode-connected bipolar transistors Q5 and Q6—are connected in series between R8 and circuit common. The PTAT voltage across R8 is deliberately scaled to cancel the negative temperature coefficients of the $V_{BE}$ voltages of Q5 and Q6.

One advantage with this configuration with respect to the configuration of FIG. 2*a* is that here, the feedback loop is easier to stabilize. This is because the impedance seen at the drain of PM1 is lower and therefore the pole at the drain of PM1 is shifted to a much higher frequency. As noted above, the negative feedback loop can be compensated with a capacitance C1 connected between the supply voltage and the output of current mirror 14.

Figure 9:
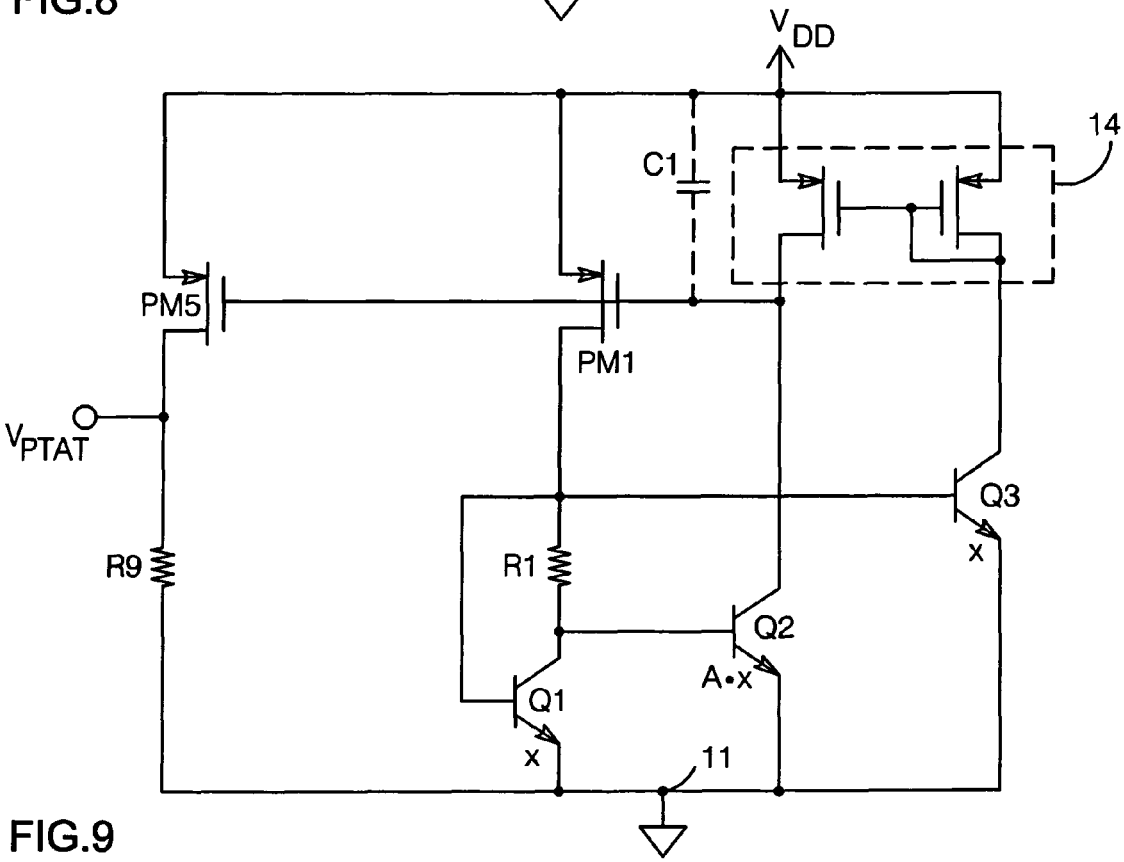
FIG. 9 is a schematic diagram of an embodiment of a circuit per the present invention which operates as a PTAT voltage generator.

In FIG. 2*a*, the currents that flow through the current mirror transistors and PM1 are the same as the PTAT current in R1 when the base currents are neglected. Thus, the basic configuration of three bipolar transistors, current mirror and feedback transistor described above can also be arranged as a PTAT current generator; FIG. 9 shows one possible embodiment. Q1-Q3, current mirror 14, feedback transistor 16 and R1 are arranged such that PM1 conducts a total current which is PTAT. A transistor PM5 mirrors the PTAT current of PM1 to a resistance R9, thereby producing a PTAT voltage across R9, and thus a PTAT output voltage $V_{PTAT}$ at the junction of PM5 and R9. Since $V_{PTAT}$ is proportional-to-absolute-temperature, this circuit may be used for temperature sensing.

Figure 10:
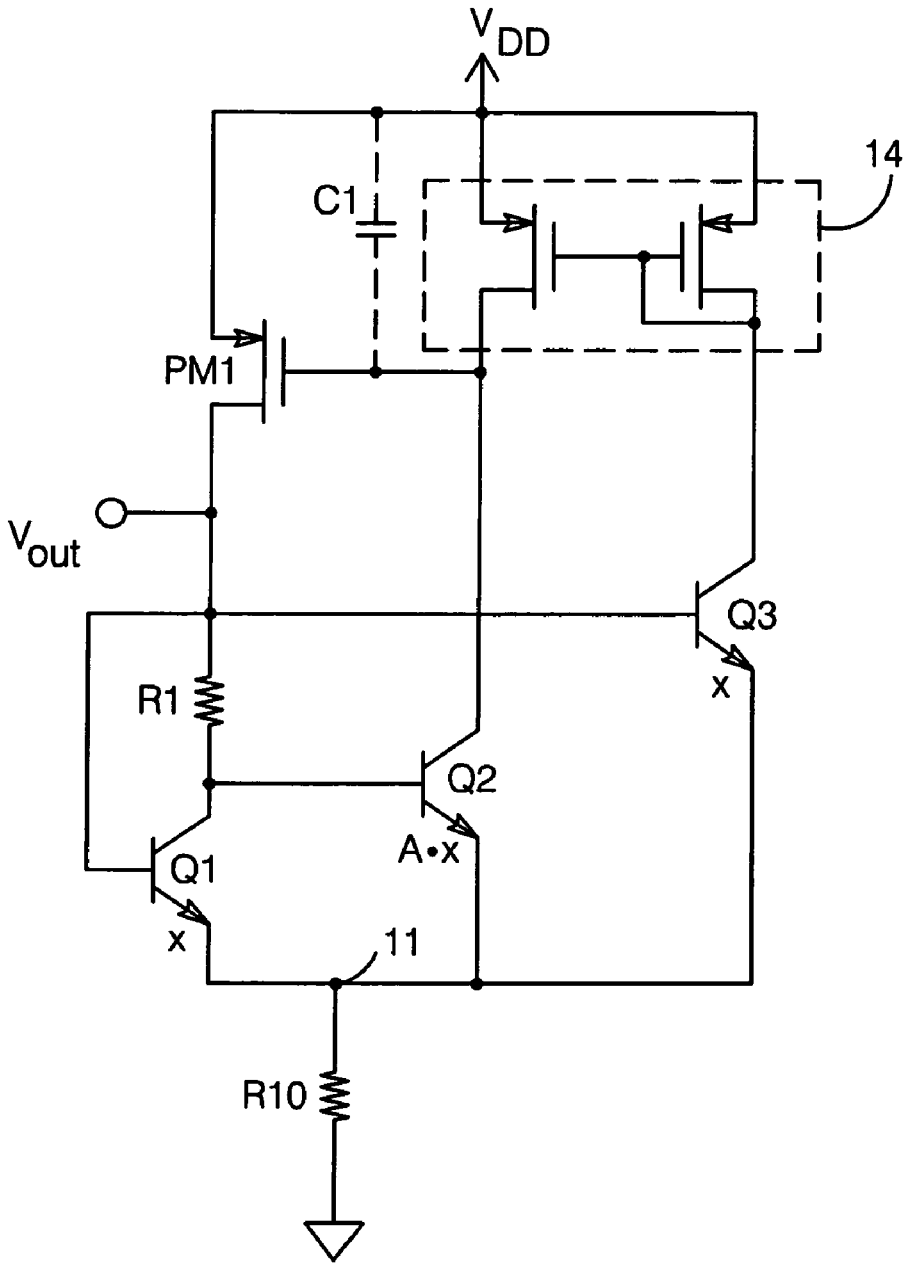
FIG. 10 is a schematic diagram of another possible embodiment of a voltage regulator circuit per the present invention.

FIG. 10 shows another possible embodiment of the present regulator circuit. Here, a resistance R10 is connected between the Q1/Q2/Q3 emitters and ground. The current through R10 is PTAT, and so a PTAT voltage is developed across R10. The amount of PTAT voltage can be adjusted via the value of R10 to compensate for the temperature dependency of the $V_{BE}$ of Q1 such that a first order temperature invariant voltage appears at node $V_{out}$.

The regulator circuits described herein employ NPN bipolar transistors as the core components for generating the PTAT $\Delta V_{BE}$ voltage used to produce a temperature invariant or temperature dependent voltage. Note, however, that it is also possible to implement a regulator circuit in accordance with the present invention using transistors having the opposite polarity to those shown in the exemplary embodiments. When so arranged, the signals in the circuit are inverted but the operating principles remain the same.

As noted above, it is required that the current densities in Q1 and Q2 be different. This can be provided by either making the emitter area of Q2 greater than that of Q1, or establishing a desired ratio between the transistors' respective collector currents. The latter option can be accommodated by setting the input/output current ratio for current mirror 14 to a value greater than one. The ratio can be set to, for example, increase the current density ratio between Q1 and Q2 to provide a larger $\Delta V_{BE}$ value, or to enable Q1, Q2 and Q3 to all be the same size. The mirror transistors are preferably relatively long channel FET devices, to help insure matching and manufacturability.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A voltage regulator circuit, comprising:

an output node;

a supply voltage;

a first bipolar transistor (Q1);

a second bipolar transistor (Q2), said first and second bipolar transistors arranged to operate at different current densities;

a first resistance R1 connected between the collector and base of said first bipolar transistor, the collector of said first bipolar transistor also connected to the base of said second bipolar transistor such that the difference between the base-emitter voltages of said first and second bipolar transistors (ΔVBE) appears across said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage, connected between the collectors of said second and third bipolar transistors, and arranged to balance the collector current of one of said second and third bipolar transistors with an image of the collector current of said first bipolar transistor when said output node is at a unique operating point; and a feedback transistor which is connected between said supply voltage and said output node, said voltage regulator circuit arranged such that said feedback transistor provides current to the bases of each of said first, second and third bipolar transistors and to said output node and is driven by the output of said current mirror so as to regulate the voltage at said output node by negative feedback.

2. The voltage regulator circuit of claim 1, wherein said voltage regulator circuit is arranged such that said operating point includes a component which is PTAT and a component which is complementary-to-absolute temperature (CTAT), said circuit arranged such that the ratio of said PTAT and CTAT components is such that said operating point has a desired temperature characteristic.

3. The voltage regulator circuit of claim 2, wherein said CTAT and PTAT components are arranged such that said operating point is temperature invariant to a first order.

4. The voltage regulator circuit of claim 3, wherein said voltage regulator circuit is arranged such that said operating point is approximately equal to the bandgap voltage of silicon at 0° K.

5. The voltage regulator circuit of claim 1, wherein said feedback transistor is a MOSFET.

6. The voltage regulator circuit of claim 1, further comprising a compensation capacitance connected between the output of said current mirror and said supply voltage or a circuit common node which provides frequency compensation for said circuit's negative feedback loop.

7. The voltage regulator circuit of claim 1, wherein said first, second and third bipolar transistors have a common polarity, said current mirror arranged to mirror the current conducted by said third bipolar transistor to said second bipolar transistor, said feedback transistor having a polarity opposite that of said first, second and third bipolar transistors.

8. The voltage regulator circuit of claim 1, wherein said first, second and third bipolar transistors have a common polarity, said current mirror arranged to mirror the current conducted by said second bipolar transistor to said third bipolar transistor, said feedback transistor having the same polarity as said first, second and third bipolar transistors.

9. The voltage regulator circuit of claim 1, wherein said voltage regulator circuit is a 3-terminal regulator which, when connected between said supply voltage and a circuit common node, regulates the voltage at said output node with respect to said circuit common node.

10. The voltage regulator circuit of claim 1, wherein said voltage regulator circuit is arranged such that the currents conducted by said first and second bipolar transistors are maintained approximately equal, such that the voltage ΔVBE across said first resistance is given by:

$$\Delta VBE=\ln(A)*(kT/q),$$

where A is the ratio between the emitter area of said second bipolar transistor with respect to the emitter area of said first bipolar transistor, k is Boltzmann's constant, T is the temperature in degrees Kelvin, and q is the magnitude of electronic charge.

11. The voltage regulator circuit of claim 1, wherein said voltage regulator circuit is arranged such that the currents conducted by said second and third bipolar transistors are maintained approximately equal, such that the voltage ΔVBE across said first resistance is given by:

$$\Delta VBE=\ln(A)*(kT/q),$$

where A is the ratio between the emitter area of said second bipolar transistor with respect to the emitter area of said third bipolar transistor, k is Boltzmann's constant, T is the temperature in degrees Kelvin, and q is the magnitude of electronic charge.

12. The voltage regulator circuit of claim 1, wherein the base and emitter of said third bipolar transistor are connected to the base and emitter, respectively, of said first bipolar transistor.

13. The voltage regulator circuit of claim 1, further comprising a second resistance R2 connected between said output node and the junction between the base of said first bipolar transistor and said first resistance.

14. The voltage regulator circuit of claim 13, wherein said voltage regulator circuit is arranged such that the voltage Vout at said output node is approximately given by:

Vout≈VBE+ΔVBE(R2/R1), where VBE is the base-emitter voltage of said first bipolar transistor.

15. The voltage regulator circuit of claim 13, further comprising a third resistance Rx connected between the base and emitter of said first bipolar transistor, said circuit arranged such that said operating point is approximately equal to the bandgap voltage of silicon at 0° K or a multiple thereof.

16. The voltage regulator circuit of claim 15, wherein said voltage regulator circuit is arranged such that the voltage Vout at said output node is approximately given by:

$$Vout=VBE*[(1+(R2/Rx)]+\Delta VBE*(R2/R1).$$

17. The voltage regulator circuit of claim 1, further comprising:

a mirror transistor connected to mirror the current conducted by said feedback transistor to a first node;

a second resistance R9 connected between said first node and a circuit common node;

said voltage regulator circuit arranged such that the voltage at said first node is proportional-to-absolute-temperature (PTAT).

18. The voltage regulator circuit of claim 1, wherein the emitters of said first, second and third bipolar transistors are connected to a common junction, further comprising a second resistance R10 connected between said common junction and circuit ground.

19. The voltage regulator circuit of claim 18, wherein R10 is selected such that the voltage at said output node is temperature invariant to a first order.

20. The voltage regulator circuit of claim 1, wherein said first, second and third bipolar transistors have a common polarity, said current mirror comprising FETs having a polarity opposite that of said first, second and third bipolar transistors.

21. The voltage regulator circuit of claim 1, wherein said current mirror has an associated input current and output current and is arranged to provide a desired ratio between said input and output currents, said current mirror arranged to provide a ratio other than one and thereby effect said different current densities in said first and second bipolar transistors.

22. The voltage regulator circuit of claim 1, wherein the emitter areas of said first and third bipolar transistors are approximately equal and the emitter area of said second bipolar transistor is greater than that of said first and third bipolar transistors.

23. A voltage regulator circuit, comprising:

an output node;

a supply voltage;

a first bipolar transistor (Q1);

a second bipolar transistor (Q2), said first and second bipolar transistors arranged to operate at different current densities;

a first resistance R1 connected between said bipolar transistors such that the difference between the base-emitter voltages of said first and second bipolar transistors (ΔVBE) appears across said first resistance;

a second resistance R2 connected between said output node and the junction between the base of said first bipolar transistor and said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said output node is at a unique operating point; and a feedback transistor which is connected between said supply voltage and said output node, said voltage regulator circuit arranged such that said feedback transistor provides current to the bases of each of said first, second and third bipolar transistors and to said output node and is driven by the output of said current mirror so as to regulate the voltage at said output node by negative feedback;

wherein said first resistance is connected between the collector and base of said first bipolar transistor, further comprising a third resistance R3 connected between the collector of said first bipolar transistor and the base of said second bipolar transistor, the value of said third resistance selected so as to reduce the variation of said output voltage with the beta values of said first, second and third bipolar transistors that would otherwise occur.

24. The voltage regulator circuit of claim 23, wherein the value of third resistance is approximately twice that of said first resistance.

25. A voltage regulator circuit, comprising:

an output node;

a supply voltage;

a first bipolar transistor (Q1);

a second bipolar transistor (Q2), said first and second bipolar transistors arranged to operate at different current densities;

a first resistance R1 connected between said bipolar transistors such that the difference between the base-emitter voltages of said first and second bipolar transistors (ΔVBE) appears across said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said output node is at a unique operating point;

a feedback transistor which is connected between said supply voltage and said output node, said voltage regulator circuit arranged such that said feedback transistor provides current to the bases of each of said first, second and third bipolar transistors and to said output node and is driven by the output of said current mirror so as to regulate the voltage at said output node by negative feedback, wherein said first resistance is connected between the base and collector of said first bipolar transistor and said feedback transistor is connected between said supply voltage and the junction between said first resistance and the base of said first bipolar transistor such that said feedback transistor conducts a current which includes a component that is PTAT;

a second resistance R4 connected between the base and emitter of said first bipolar transistor such that it conducts a current which is complementary-to-absolute-temperature (CTAT), such that the current conducted by said feedback transistor also includes a CTAT component, said voltage regulator circuit arranged such that said total current conducted by said feedback transistor is temperature invariant to a first order;

a third resistance R5 connected between the base of said first bipolar transistor and a first node (42);

a mirror transistor connected to mirror the current conducted by said feedback transistor to said first node; and a fourth bipolar transistor (Q4) connected between said first node and a circuit common node and arranged such that its current density is approximately equal to that of said first bipolar transistor at a predetermined reference temperature;

said third resistance, mirror transistor and fourth bipolar transistor arranged to provide a correction current in said third resistance which substantially reduces the magnitude of the (kT/q)ln(To/T) curvature component in the CTAT component of the current conducted by said feedback transistor that would otherwise be present.

26. The voltage regulator circuit of claim 25, further comprising:

a second mirror transistor connected to mirror the current conducted by said feedback transistor to a second node; and a fourth resistance R6 connected between said second node and said circuit common node, said voltage regulator circuit arranged such that a curvature-corrected voltage Vref is produced at said second node given by:

$$Vref = R6 \cdot \left[ \frac{VG0}{R4} + \frac{VBEO - VG0}{R4} \frac{T}{To} + \frac{(m-1)}{R4}\left(\frac{kT}{q}\right)\ln\left(\frac{To}{T}\right) - \frac{1}{R5}\left(\frac{kT}{q}\right)\ln\left(\frac{To}{T}\right) + \frac{\Delta VBE}{R1} \right],$$

where VBE0 is the value of VBE measured at a reference temperature To while conducting a reference current Io, VG0 is the bandgap voltage of silicon extrapolated to 0° K, and m is a fabrication process-specific constant.

27. The voltage regulator circuit of claim 25, wherein said fourth bipolar transistor is diode-connected.

28. The voltage regulator circuit of claim 25, further comprising:

a buffer amplifier connected between said first node and said third resistance with said amplifier's input connected to said first node and its output connected to said third resistance, the base of said fourth bipolar transistor connected to the output of said buffer amplifier such that said amplifier provides said correction current to said third resistance and reduces the loading of said first node that would otherwise be present.

29. The voltage regulator circuit of claim 28, wherein said buffer amplifier comprises:

an NMOS FET having is drain coupled to said supply voltage and its gate and source connected to the collector and base of said fourth bipolar transistor, respectively; and a fourth resistance connected between said NMOS FET's source and said circuit common node.

30. The voltage regulator circuit of claim 25, wherein resistance R5 is set equal to R4/(m−1), where m is a fabrication process-specific constant.

31. A voltage regulator circuit, comprising:

a supply voltage;

a first bipolar transistor (Q1);

a second bipolar transistor (Q2), said first and second bipolar transistors arranged to operate at different current densities;

a first resistance R1 connected between said bipolar transistors such that the difference between the base-emitter voltages of said first and second bipolar transistors (ΔVBE) appears across said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said output node is at a unique operating point;

a feedback transistor which is connected between said supply voltage and said output node, said voltage regulator circuit arranged such that said feedback transistor provides current to the bases of each of said first, second and third bipolar transistors and to said output node and is driven by the output of said current mirror so as to regulate the voltage at said output node by negative feedback;

a mirror transistor connected to mirror the current conducted by said feedback transistor to a first node;

a second resistance R8 connected between said first node and a second node; and one or more p-n junction devices connected in series between said second node and a circuit common node;

said voltage regulator circuit arranged such that the voltage at said first node is approximately equal to the bandgap voltage of silicon at 0° K or a multiple thereof.

32. The voltage regulator circuit of claim 31, wherein said p-n junction devices comprise respective diode-connected bipolar transistors.

33. A curvature-corrected voltage regulator circuit, comprising:

a first node;

a supply voltage;

a first bipolar transistor (Q1);

a second bipolar transistor (Q2), said first and second bipolar transistors arranged to operate at different current densities;

a first resistance R1 connected between the base and collector of said first bipolar transistor and between the bases of said first and second bipolar transistor such that the difference between the base-emitter voltages of said first and second bipolar transistors (ΔVBE) appears across said first resistance, the junction of said first bipolar transistor and said first resistance connected to said first node;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said first node is at a unique operating point, said operating point including a component which is PTAT and a component which is complementary-to-absolute temperature (CTAT);

a feedback transistor which is connected between said supply voltage and said first node, said voltage regulator circuit arranged such that said feedback transistor provides current to the bases of each of said first, second and third bipolar transistors and to said first node and is driven by the output of said current mirror so as to regulate the voltage at said first node by negative feedback;

a second resistance R4 connected between the base and emitter of said first bipolar transistor such that it conducts a current which is complementary-to-absolute-temperature (CTAT), such that the current conducted by said feedback transistor also includes a CTAT component, said voltage regulator circuit arranged such that said total current conducted by said feedback transistor is temperature invariant to a first order;

a third resistance R5 connected between the base of said first bipolar transistor and a second node (42);

a mirror transistor connected to mirror the current conducted by said feedback transistor to said second node; and a fourth bipolar transistor (Q4) connected between said second node and a circuit common node and arranged such that its current density is approximately equal to that of said first bipolar transistor at a predetermined reference temperature;

said third resistance, mirror transistor and fourth bipolar transistor arranged to provide a correction current in said third resistance which substantially reduces the magnitude of the (kT/q)ln(To/T) curvature component in the CTAT component of the current conducted by said feedback transistor that would otherwise be present.

34. The voltage regulator circuit of claim 33, further comprising:

a second mirror transistor connected to mirror the current conducted by said feedback transistor to a third node; and a fourth resistance R6 connected between said third node and said circuit common node, said voltage regulator circuit arranged such that a curvature-corrected voltage Vref is produced at said third node given by:

$$Vref = R6 \cdot \left[ \frac{VG0}{R4} + \frac{VBEO - VG0}{R4} \frac{T}{To} + \frac{(m-1)}{R4}\left(\frac{kT}{q}\right)\ln\left(\frac{To}{T}\right) - \frac{1}{R5}\left(\frac{kT}{q}\right)\ln\left(\frac{To}{T}\right) + \frac{\Delta VBE}{R1} \right],$$

where VBE0 is the value of VBE measured at a reference temperature To while conducting a reference current Io, VG0 is the bandgap voltage of silicon extrapolated to 0° K, and m is a fabrication process-specific constant.

35. The voltage regulator circuit of claim 33, further comprising:

a buffer amplifier connected between said second node and said third resistance with said amplifier's input connected to said second node and its output connected to said third resistance, the base of said fourth bipolar transistor connected to the output of said buffer amplifier such that said amplifier provides said correction current to said third resistance and reduces a loading of said second node that would otherwise be present.

36. A voltage regulator circuit, comprising:

a first node;

a supply voltage;

a first bipolar transistor (Q1);

a second bipolar transistor (Q2), said first and second bipolar transistors arranged to operate at different current densities;

a first resistance R1 connected between said bipolar transistors such that the difference between the base-emitter voltages of said first and second bipolar transistors (ΔVBE) appears across said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said first node is at a unique operating point; and a feedback transistor which is connected between said supply voltage and said first node, said voltage regulator circuit arranged such that said feedback transistor provides current to the bases of each of said first, second and third bipolar transistors and to said first node and is driven by the output of said current mirror so as to regulate the voltage at said first node by negative feedback;

a mirror transistor connected to mirror the current conducted by said feedback transistor to a second node;

a second resistance R8 connected between said second node and a third node; and one or more p-n junction devices connected in series between said third node and a circuit common node;

said voltage regulator circuit arranged such that the voltage at said second node is approximately equal to the bandgap voltage of silicon at 0° K or a multiple thereof.

37. A proportional-to-absolute-temperature (PTAT) voltage generator, comprising:

a first node;

a supply voltage;

a first bipolar transistor (Q1);

a second bipolar transistor (Q2), said first and second bipolar transistors arranged to operate at different current densities;

a first resistance R1 connected between said bipolar transistors such that the difference between the base-emitter voltages of said first and second bipolar transistors (ΔVBE) appears across said first resistance;

a third bipolar transistor (Q3) connected to conduct a current which varies with the voltage at the base of said first bipolar transistor, the voltages at the bases of said first and third bipolar transistors being equal or differing by a voltage which is proportional-to-absolute-temperature (PTAT);

a current mirror referenced to said supply voltage and arranged to balance the collector current of one of said second and third bipolar transistors with an image of the collector current of said first bipolar transistor when said first node is at a unique operating point; and a feedback transistor which is connected between said supply voltage and said first node, said voltage regulator circuit arranged such that said feedback transistor provides current to the bases of each of said first, second and third bipolar transistors and to said first node and is driven by the output of said current mirror so as to regulate the voltage at said first node by negative feedback;

a mirror transistor connected to mirror the current conducted by said feedback transistor to a second node;

a second resistance R9 connected between said second node and a circuit common node;

said voltage regulator circuit arranged such that the voltage at said second node is proportional-to-absolute-temperature (PTAT).

* * * * *

UNITED STATES PATENT AND TRADEMARK OFFICE

CERTIFICATE OF CORRECTION

PATENT NO. : 8,159,206 B2
APPLICATION NO. : 12/313834
DATED : April 17, 2012
INVENTOR(S) : Hio Leong Chao It is certified that error appears in the above-identified patent and that said Letters Patent is hereby corrected as shown below:

In the Claims:
Column 13, Claim 31, Line 1, after "A voltage regulator circuit, comprising:" Please add --an output node;--

Signed and Sealed this
Thirteenth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,159,206 B2
APPLICATION NO. : 12/313834
DATED : April 17, 2012
INVENTOR(S) : Hio Leong Chao It is certified that error appears in the above-identified patent and that said Letters Patent is hereby corrected as shown below:

In the Claims:
Column 13, Line 41 (Claim 31, Line 1) after "A voltage regulator circuit, comprising:" Please add --an output node;--

This certificate supersedes the Certificate of Correction issued November 13, 2012.

Signed and Sealed this
Eleventh Day of December, 2012

David J. Kappos

David J. Kappos
*Director of the United States Patent and Trademark Office*